United States Patent [19]

Fleck

[11] 4,322,774

[45] Mar. 30, 1982

[54] ARRANGEMENT FOR GENERATING IONS

[76] Inventor: Carl M. Fleck, Schelleingasse 14/2, Vienna, Austria

[21] Appl. No.: 54,703

[22] Filed: Jul. 5, 1979

[30] Foreign Application Priority Data

Jul. 6, 1978 [AT] Austria ..... 4921/78

[51] Int. Cl.[3] ..... H01T 19/00

[52] U.S. Cl. ..... 361/231; 361/230

[58] Field of Search ..... 361/225, 229, 230, 212, 361/213, 214, 231

[56] References Cited

U.S. PATENT DOCUMENTS 3,483,372 12/1969 Benson ..... 361/230 X
3,818,269 6/1974 Stark ..... 361/231
4,053,769 10/1977 Nishikawa et al. ..... 361/213
4,139,879 2/1979 Laws ..... 361/231
4,185,316 1/1980 Fleck ..... 361/231

FOREIGN PATENT DOCUMENTS 2134698 1/1973 Fed. Rep. of Germany ..... 361/229

*Primary Examiner*—J. D. Miller
*Assistant Examiner*—L. C. Schroeder

[57] ABSTRACT

An apparatus is disclosed for generating ions into the atmosphere in which ion generation from a high voltage wire electrode is enhanced and accelerated by a high voltage reflective screen and a partially conductive auxiliary electrode which collects a charge. The auxiliary electrode defines an opening through which the ions pass and are accelerated. The apparatus is contained in an insulating housing.

4 Claims, 2 Drawing Figures

ARRANGEMENT FOR GENERATING IONS

The invention relates to an arrangement for generating ions, especially for ionisation of air. The arrangement has an electrically conducting wire connected to a high voltage source and a reflector screen arranged at a distance from the wire. This screen is at a high electric potential and the screen partly encloses the wire. The screen is held in an insulating housing with an opening allowing passage of ions. The high electric potential on the reflector screen has the same polarity as the wire potential.

Arrangements of this kind have the disadvantage that the repulsing effect of the wire on the electrons or ions decreases rapidly with increasing distance. Hence also the velocity of the emitted ions is rapidly reduced together with increasing distance from the wire. A low velocity, however, considerably promotes the deposition of ions on dust particles whence the movement of the ions will stop completely. Hence it becomes impossible to enrich a room to some extent uniformly with ions.

It is, in principle, also possible to provide additional electrodes which have a repulsing effect on the electrons or ions in order to achieve a higher repulsion effect at a greater distance from the wire. However, in doing this the voltage applied to the additional electrodes is very critical. If, for example, too low a voltage is applied to the additional diode then its effect is also very low so that the problems described above will still exist and no significant improvement of the distribution of ions in the room is achieved. However, a higher voltage applied to the additional electrode causes a sensible reduction of the electric field on the wire. Hence, however, the emission of ions or electrodes is markedly retarded and emission will completely stop at excessively high voltage on the additional electrode. With an additional electrode which is connected to a fixed potential it is possible to achieve the required effect of increase of velocity of ions at a greater distance from the wire; in any case there exists the danger that under certain circumstances the emission of electrons or ions will completely stop and the additional electrode becomes ultimately ineffective because any such ions whose velocity could be increased no longer exist. This undesirable side effect could only be avoided by a relatively expensive monitoring and control arrangement which monitors the emission of electrons or ions and if the emission falls below a certain value then it initiates suitable correction measures, for example a decrease of the potential applied to the additional electrode.

The objective of the invention is to propose an arrangement mentioned above which on the one hand ensures a sufficiently high velocity of the emitted electrons or ions at a greater distance from the wire used as an ionisation source in order to prevent deposition of ions on dust particles to a greater extent and which, on the other hand, has a very simple design and which operates without expensive regulating and monitoring arrangements.

According to the invention this is achieved by providing an auxiliary electrode which projects at least along one part of the circumference of the passage opening of the housing and which is placed on the housing with insulation.

The auxiliary electrode is charged by the emission of electrons or ions due to the wire under high voltage.

The increasing potential of the auxiliary electrode causes focussing, increasing in intensity, of the emerging electron or ion flux so that fewer and fewer electrons reach the auxiliary electrode and the increase of the auxiliary electrode potential is retarded and finally it comes to a stop. At the same time, together with increasing potential of the auxiliary electrode, the forces, caused by the electrode, which exert repulsing effect on the electrons or ions, increase.

Suppression of electron or ion emission of the kind possible with an auxiliary electrode at a fixed potential cannot, however, occur or will occur only for a short time because the auxiliary electrode,s due to finite insulation resistance of the insulating materials, is constantly discharged and the potential of the auxiliary electrode when emission of electrons is suppressed is constantly reduced which causes renewed emission of electrons from the wire.

The design, according to the invention, of an arrangement for generating ions hence ensures an automatic regulation of the potential applied to the auxiliary electrode.

Experiments have shown that the form and spacing of the auxiliary electrode and the insulating material specified between the electrode and the housing can be varied without disturbing the self stabilising effect of the arrangement according to the invention. Especially favourable emission conditions are obtained if the auxiliary electrode is designed as a plate with a perforation.

The auxiliary electrode is usefully made from metal and it can be provided with thin insulating coats, for example electrolytically applied oxide layers, lacquer coatings or plastics material coatings which ensures scope for influencing the charging and discharging rate of the auxiliary electrode.

In some cases it is also advantageous if the auxiliary electrode is made from an insulating material whose surface conductivity is higher than that of the housing.

By suitable selection of the materials used, and also if necessary by suitable selection of surface treatment of the housing and auxiliary electrode, it is possible to adjust the required charging and discharging rate of the electrode which is important especially in arrangements for low frequency pulsating emission of electrons.

The invention is now explained by means of the drawing.

Figure 1:
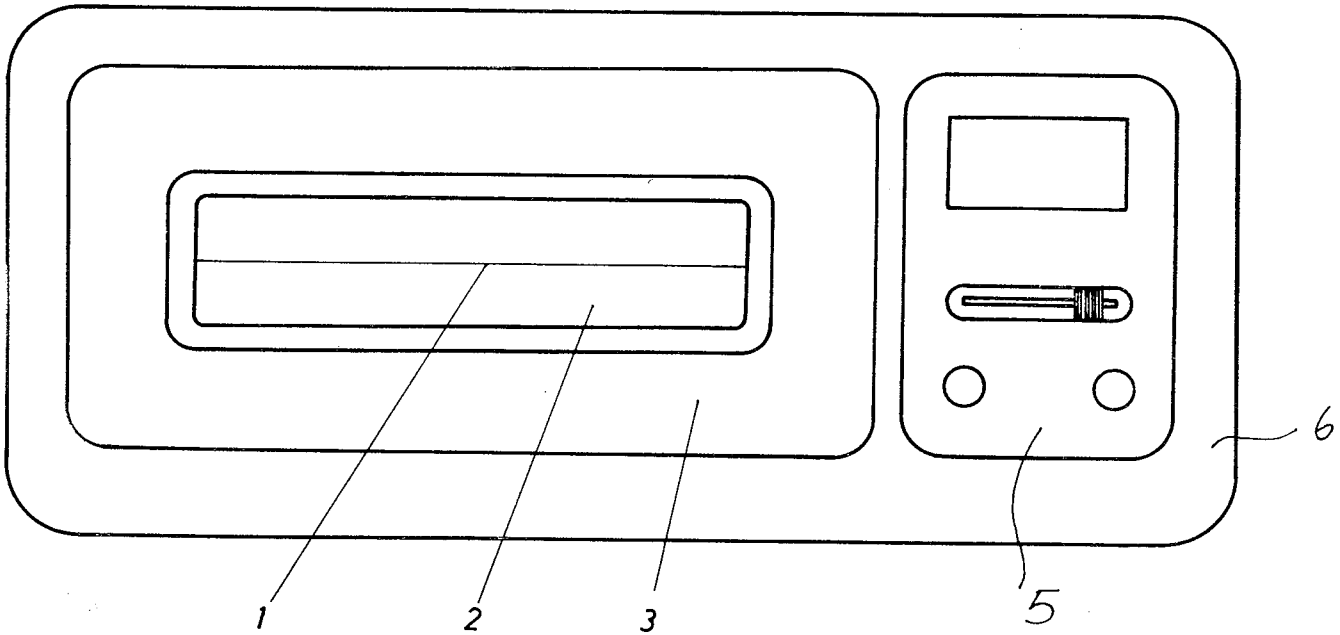
FIG. 1 shows a front view.
Figure 2:
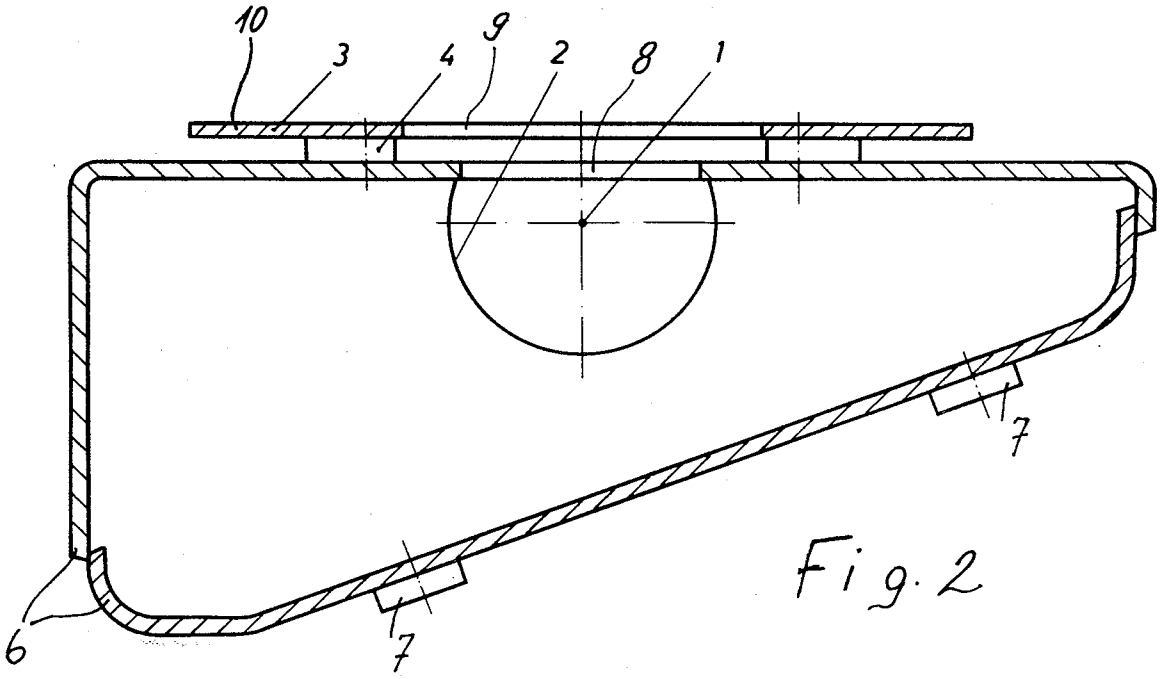
FIG. 2 shows a cross section through an arrangement according to the invention on an enlarged scale.

The electrically conducting wire is designated by 1, and to this wire, as well as to the reflector screen 2 partly enclosing the wire 1, can be applied a high voltage adjusted by means of the control system 5 in which the potentials applied to the wire or reflector screen 2 have different values but the same polarity.

The wire 1, reflector screen 2 and control system 5 are arranged in a housing 6 made from insulating material which is fastened by brackets 7 for example on a wall. The opening 8 of the housing 6 facilitates the exit of emitted electron or ion flux.

On the outside of the housing 6 an auxiliary electrode 3 is mounted on a stand 4 of insulating material. This electrode extends along the circumference of the opening 8 of the housing 6 and is designed as a plate 10 provided with a perforation 9.

I claim:

1. An arrangement for generating ions and for emitting the generated ions into the atmosphere, comprising an electrically conducting wire connected to a high voltage source, source, a reflector screen at a high electric potential arranged at a distance from the wire and partly surrounding the wire, the high electric potential on the reflector screen having the same polarity as the high voltage applied to the wire, an electrically insulating housing wherein the wire and reflector screen are mounted, the housing defining an opening in alignment with the wire and permitting passage of ions from the wire into the atmosphere outside the housing, an auxiliary electrode mounted on the housing adjacent the opening and extending at least along a part of the circumference of the opening, the auxiliary electrode being at least partially electrically conducting whereby it is charged by the ions, and electrically insulating means mounting the auxiliary electrode on the electrically insulating housing whereby the auxiliary electrode may be charged by the ions passing through the opening and the auxiliary electrode concentrates and repels the emitted ions.

2. The arrangement of claim 1, wherein the auxiliary electrode is a plate extending along the circumference of the opening and defines a perforation in alignment with the opening.

3. The arrangement of claim 1, wherein the auxiliary electrode is of metal and carries a coating of insulating material.

4. The arrangement of claim 1, wherein the auxiliary electrode is of insulating material having a surface conductivity higher than that of the housing.

* * * * *